US011206927B2

(12) United States Patent
Garrison

(10) Patent No.: US 11,206,927 B2
(45) Date of Patent: Dec. 28, 2021

(54) COLLAPSIBLE ROCKING CHAIR WITH IMPROVED FOLDING MECHANISM

(71) Applicant: Rio Brands LLC, Watertown, CT (US)

(72) Inventor: Scott A. Garrison, Fitchburg, WI (US)

(73) Assignee: ShelterLogic Corp., Watertown, CT (US)

( * ) Notice: Subject to any disclaimer, the term of this patent is extended or adjusted under 35 U.S.C. 154(b) by 0 days.

(21) Appl. No.: 16/733,923

(22) Filed: Jan. 3, 2020

(65) Prior Publication Data

US 2020/0214450 A1 Jul. 9, 2020

Related U.S. Application Data

(60) Provisional application No. 62/790,227, filed on Jan. 9, 2019.

(51) Int. Cl.

| | |
|---|---|
| ***A47C 3/025*** | (2006.01) |
| ***A47C 4/28*** | (2006.01) |
| ***A47C 4/34*** | (2006.01) |
| ***A47C 4/44*** | (2006.01) |
| ***A47C 7/62*** | (2006.01) |
| *A47C 1/14* | (2006.01) |

(52) U.S. Cl.

CPC ..... *A47C 4/28* (2013.01); *A47C 3/0252* (2013.01); *A47C 7/624* (2018.08); *A47C 1/14* (2013.01)

(58) Field of Classification Search

CPC ..... A47C 4/28; A47C 7/624; A47C 3/0252; A47C 1/14; A47C 4/44; A47C 4/34; A47C 4/283

USPC ..... 297/16.1, 20, 27, 31, 32, 39, 46, 47, 55, 297/59, 258.1, 259.2, 259.4, 264.1

See application file for complete search history.

(56) References Cited

U.S. PATENT DOCUMENTS

| | | | |
|---|---|---|---|
| 200,204 A | 2/1878 | Krapp | |
| 200,296 A | 2/1878 | Hesse | |
| 239,754 A | 4/1881 | Flinn | |
| 581,762 A | 5/1897 | Neuens | |
| 787,299 A | 4/1905 | Koeser | |

(Continued)

FOREIGN PATENT DOCUMENTS

| | | | | |
|---|---|---|---|---|
| CH | 269753 A | * | 7/1950 | ..... A47C 4/44 |
| CN | 201101281 Y | * | 8/2008 | |

(Continued)

*Primary Examiner* — Robert Canfield

(74) *Attorney, Agent, or Firm* — Carmody Torrance Sandak & Hennessey LLP

(57) ABSTRACT

A chair comprising preferably including a seat frame coupled to a back frame; a seat panel coupled to the seat frame and a back support panel coupled to the back frame; a front leg frame coupled to a back leg frame; a first arm rest coupled at one end thereof to a first segment of the back frame; a second arm rest coupled at one end thereof to a second segment of the back frame; a front leg crossbar coupled between a first segment of the front leg frame and a second segment of the front leg frame; a rear leg crossbar coupled between a first segment of the back leg frame and a second segment of the back leg frame; and an assembly that permits a collapsing the chair from at least an open position to a collapsed position and flexing members that will flex during a rocking of the chair between at least one of a rearward and forward position to the other of the forward and rearward position.

18 Claims, 9 Drawing Sheets

(56) References Cited

U.S. PATENT DOCUMENTS

| | | | | | |
|---|---|---|---|---|---|
| 1,150,546 | A | | 8/1915 | Schram | |
| 1,488,863 | A | | 4/1924 | Caddell | |
| 1,676,074 | A | | 7/1928 | Brown | |
| 2,099,498 | A | * | 11/1937 | Platter | A47C 4/40 297/29 |
| 2,347,478 | A | * | 4/1944 | Heddens | A47C 4/36 297/29 |
| 2,467,909 | A | * | 4/1949 | Rechler | A47C 4/46 297/27 |
| 2,537,071 | A | | 1/1951 | Lukins | |
| 2,638,970 | A | * | 5/1953 | Fowler | A47C 4/48 297/39 |
| 2,649,138 | A | | 8/1953 | Rechler | |
| 2,699,815 | A | * | 1/1955 | Vanderminden | A47C 4/24 297/39 |
| 2,746,518 | A | | 5/1956 | Schneider | |
| 3,114,572 | A | * | 12/1963 | Hopkins | A47C 3/029 297/33 |
| 3,337,265 | A | | 8/1967 | Benzing | |
| 3,403,882 | A | | 10/1968 | Lindqvist | |
| 4,285,543 | A | * | 8/1981 | Clark | A47C 3/029 297/133 |
| 4,371,142 | A | | 2/1983 | Bottemiller et al. | |
| 4,596,423 | A | | 6/1986 | Towns et al. | |
| 4,772,067 | A | | 9/1988 | Glecker et al. | |
| 5,449,220 | A | * | 9/1995 | Taylor | A47C 1/029 297/16.1 |
| 5,738,409 | A | | 4/1998 | Bursik | |
| 6,209,843 | B1 | | 4/2001 | Smith, Jr. | |
| 9,060,611 | B2 | * | 6/2015 | Grace | A47C 3/027 |
| 9,282,824 | B2 | | 3/2016 | Grace | |
| 9,936,810 | B2 | * | 4/2018 | Lv | A47C 4/18 |
| 10,568,430 | B1 | | 2/2020 | Sun | |
| 2002/0135210 | A1 | | 9/2002 | Tseng | |
| 2005/0077758 | A1 | | 4/2005 | Reese | |
| 2006/0138808 | A1 | * | 6/2006 | Cui | A47C 1/035 297/30 |
| 2014/0232154 | A1 | | 8/2014 | Chen | |
| 2017/0055711 | A1 | * | 3/2017 | Goldszer | A47C 4/28 |
| 2019/0110599 | A1 | | 4/2019 | Grace | |
| 2020/0214451 | A1 | * | 7/2020 | Garrison | A47C 13/00 |

FOREIGN PATENT DOCUMENTS

| | | | |
|---|---|---|---|
| CN | 2016123392 | A | 10/2010 |
| CN | 109832859 | A | 6/2019 |
| CN | 210249186 | U | 4/2020 |
| DE | 1554179 | A1 | 5/1970 |
| GB | 183986 | | 8/1922 |
| JP | 2003116680 | A | 4/2003 |

* cited by examiner

COLLAPSIBLE ROCKING CHAIR WITH IMPROVED FOLDING MECHANISM

This application claims the benefit of U.S. application Ser. No. 62/790,227 filed on Jan. 9, 2019. The subject matter of said application Ser. No. 62/790,227 is incorporated by reference as if fully set forth herein.

BACKGROUND OF THE INVENTION

The present invention relates generally to chairs, and in particular to an improved rocker chair usable at a beach, at a picnic, or anywhere, just to name a few of many places for using such a chair, and that is also collapsible for easy transport and storage. An improved construction of such a chair is provided. Although not limited thereto, the present invention is particularly advantageous for chairs that may be used outdoors.

Rocker chairs are well known. Collapsible rocker chairs are also known in the art, for example, as described in U.S. Pat. No. 9,060,611. However, such known chairs have several deficiencies, including but not limited to, complicated constructions and expensive manufacturing costs. Therefore, a collapsible rocker chair that provides superior comfort, functionality and support, while also being manufacturable at reasonable costs and efficiencies, is highly desirable.

It is thus believed that further advances to the state of the art are both desirable and achievable, all of which are provided by the embodiments disclosed herein.

SUMMARY AND OBJECTIVES OF THE INVENTION

It is thus an objective of the present invention to overcome the perceived deficiencies in the prior art.

Specifically, objectives of the present invention include, but are not limited to, providing a rocker chair that provides for improved rocking motion capability, providing improved support for the user that is sitting and/or rocking in the chair, and providing an improved folding mechanism all of which are easier, more efficient, more reliable and more efficiently manufactured than other folding and rocker chairs known the in art.

Other objectives and advantages of the present invention will become more apparent from a consideration of the drawings and ensuing disclosure.

The invention accordingly comprises the features, combinations of elements and features, arrangement of parts and methods for using the same which will be exemplified in the description and illustrations hereinafter set forth, and the scope of the invention will be indicated in the claims.

Therefore, to overcome the deficiencies in the prior art and to achieve the objects and advantages set forth above and below, a first preferred embodiment of the present invention is, generally speaking, directed to a chair comprising a U-shaped seat frame coupled to a U-shaped back frame, a seat panel coupled to the U-shaped seat frame and a back support panel coupled to the U-shaped back frame; a U-shaped front leg frame coupled to a U-shaped back leg frame, a first arm rest coupled at one end thereof to a first segment of the U-shaped back frame; a second arm rest coupled at one end thereof to a second segment of the U-shaped back frame; a front leg crossbar coupled between a first segment of the U-shaped front leg frame and a second segment of the U-shaped front leg frame; a rear leg crossbar coupled between a first segment of the U-shaped back leg frame and a second segment of the U-shaped back leg frame; a first slider having a first end, wherein the first end of the first slider is coupled to the front leg crossbar, and wherein the first slider is supported by the rear leg crossbar; a second slider having a first end, wherein the first end of the second slider is coupled to the front leg crossbar, and wherein the first slider is supported by the rear leg crossbar; wherein during a collapsing of the chair from an open position to a collapsed position, the (i) U-shaped seat frame rotates relative to the U-shaped back frame, (ii) the U-shaped front leg frame rotates relative to the U-shaped back leg frame, (iii) the first arm rest and the second arm rest rotate relative to the U-shaped back frame, and (iv) the first and second sliders slide relative to the rear leg crossbar.

In another preferred embodiment, a chair is provided that comprises a U-shaped seat frame coupled to a U-shaped back frame, a seat panel coupled to the U-shaped seat frame and a back support panel coupled to the U-shaped back frame; a U-shaped front leg frame coupled to a U-shaped back leg frame, a first arm rest coupled at one end thereof to a first segment of the U-shaped back frame; a second arm rest coupled at one end thereof to a second segment of the U-shaped back frame; a front leg crossbar coupled between a first segment of the U-shaped front leg frame and a second segment of the U-shaped front leg frame; a rear leg crossbar coupled between a first segment of the U-shaped back leg frame and a second segment of the U-shaped back leg frame; a first crossmember coupled between a first segment of the U-shaped seat frame and a second segment of the U-shaped seat frame; a second crossmember support assembly; a second crossmember supported by the second crossmember support assembly; a first means for flexing coupled between a first end of the first crossmember and a first end of the second crossmember, and a second means for flexing coupled between a second end of the first crossmember and a second end of the second crossmember; and wherein the first and second means for flexing will flex during a rocking of the chair between at least one of a rearward and forward position to the other of the forward and rearward position.

In yet another preferred embodiment, the present invention is directed to a chair comprising a seat frame coupled to a back frame, a seat panel coupled to the seat frame and a back support panel coupled to the back frame; a front leg frame coupled to a back leg frame, a first arm rest coupled at one end thereof to a first segment of the back frame; a second arm rest coupled at one end thereof to a second segment of the back frame; a front leg crossbar coupled between a first segment of the front leg frame and a second segment of the front leg frame; a rear leg crossbar coupled between a first segment of the back leg frame and a second segment of the back leg frame; at least one of (i) a collapsing assembly for permitting a collapsing the chair from an open position to a collapsed position and (ii) means for flexing, wherein the means for flexing will flex during a rocking of the chair between at least one of a rearward and forward position to the other of the forward and rearward position. In a specific embodiment, the collapsing assembly preferably comprises a first slider having a first end, wherein the first end of the first slider is coupled to the front leg crossbar, and wherein the first slider is supported by the rear leg crossbar; a second slider having a first end, wherein the first end of the second slider is coupled to the front leg crossbar, and wherein the first slider is supported by the rear leg crossbar; wherein during a collapsing of the chair from an open position to a collapsed position, the (i) seat frame rotates relative to the back frame, (ii) the front leg frame rotates relative to the back leg frame, (iii) the first arm rest and the second arm rest rotate relative to the back frame, and (iv) the first and second sliders slide relative to the rear leg crossbar. In another specific embodiment, the means for flexing comprises a first crossmember coupled between a first segment of the seat frame and a second segment of the seat frame; a second crossmember support assembly; a second crossmember supported by the second crossmember support assembly; a first flexible member coupled between a first end of the first crossmember and a first end of the second crossmember, and a second flexible member coupled between a second end of the first crossmember and a second end of the second crossmember; and wherein the first and second flexible members will flex during a rocking of the chair between at least one of a rearward and forward position to the other of the forward and rearward position.

BRIEF DESCRIPTION OF THE DRAWINGS

The above set forth and other features of the present invention are made more apparent in the ensuing Description of the Preferred Embodiments when read in conjunction with the attached Drawings, wherein.

Identical reference numerals in the figures are intended to indicate like parts, although not every feature in every figure may be called out with a reference numeral.

DETAILED DESCRIPTION OF THE PREFERRED EMBODIMENTS

Reference is now made to the figures in combination with the following for a disclosure of the construction of a collapsible rocker chair, generally indicated at 10, constructed in accordance with a preferred embodiment of the present invention.

Figure 8:
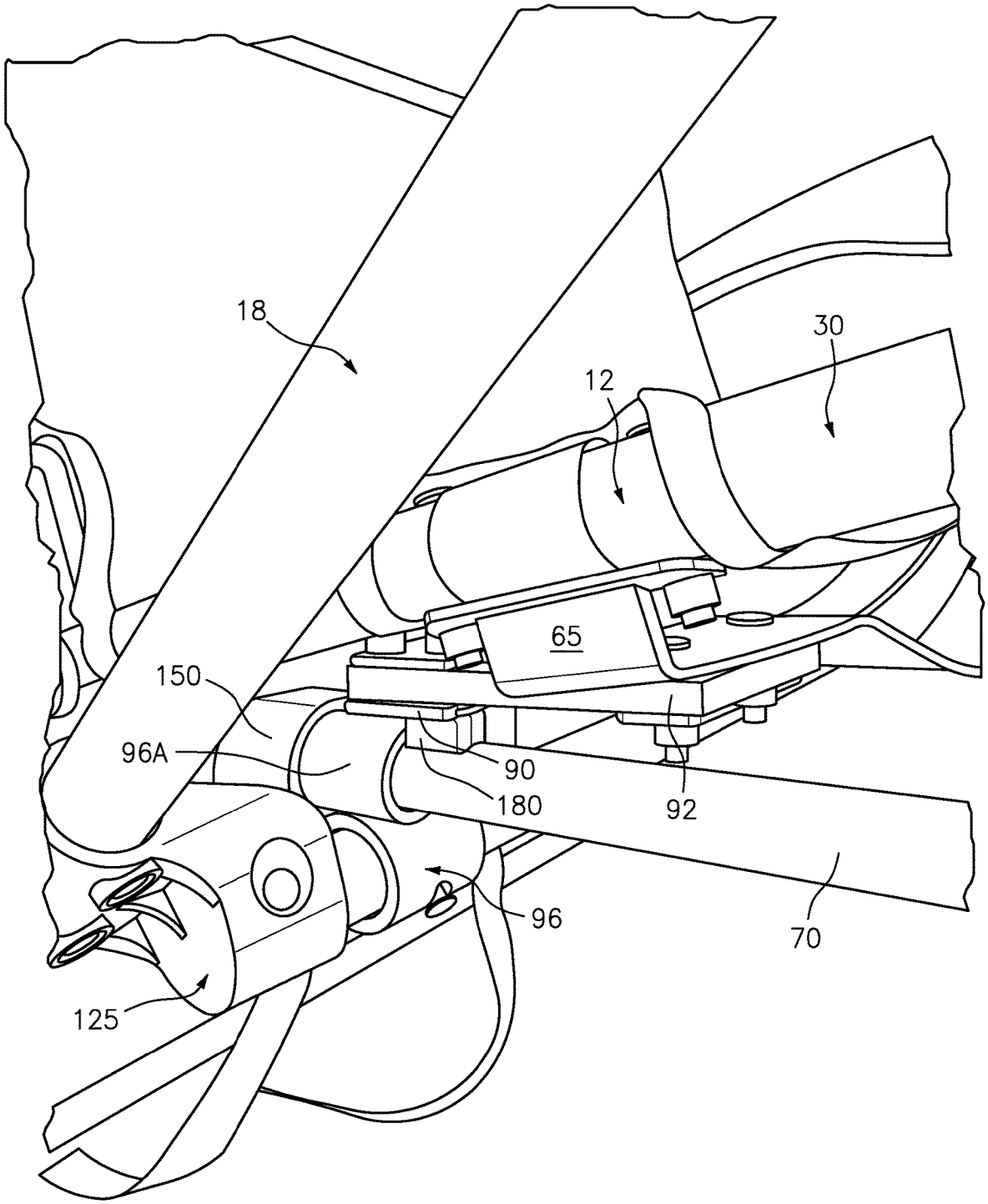
FIGS. 8 and 9 are close up perspective views of the chair of FIG. 1, with FIG. 8 particularly showing certain structures of the chair with the chair in an upright (e.g. up) position and with FIG. 9 particularly showing certain structures of the chair in a rocking/rocked back (e.g. reclining) position.
Figure 9:
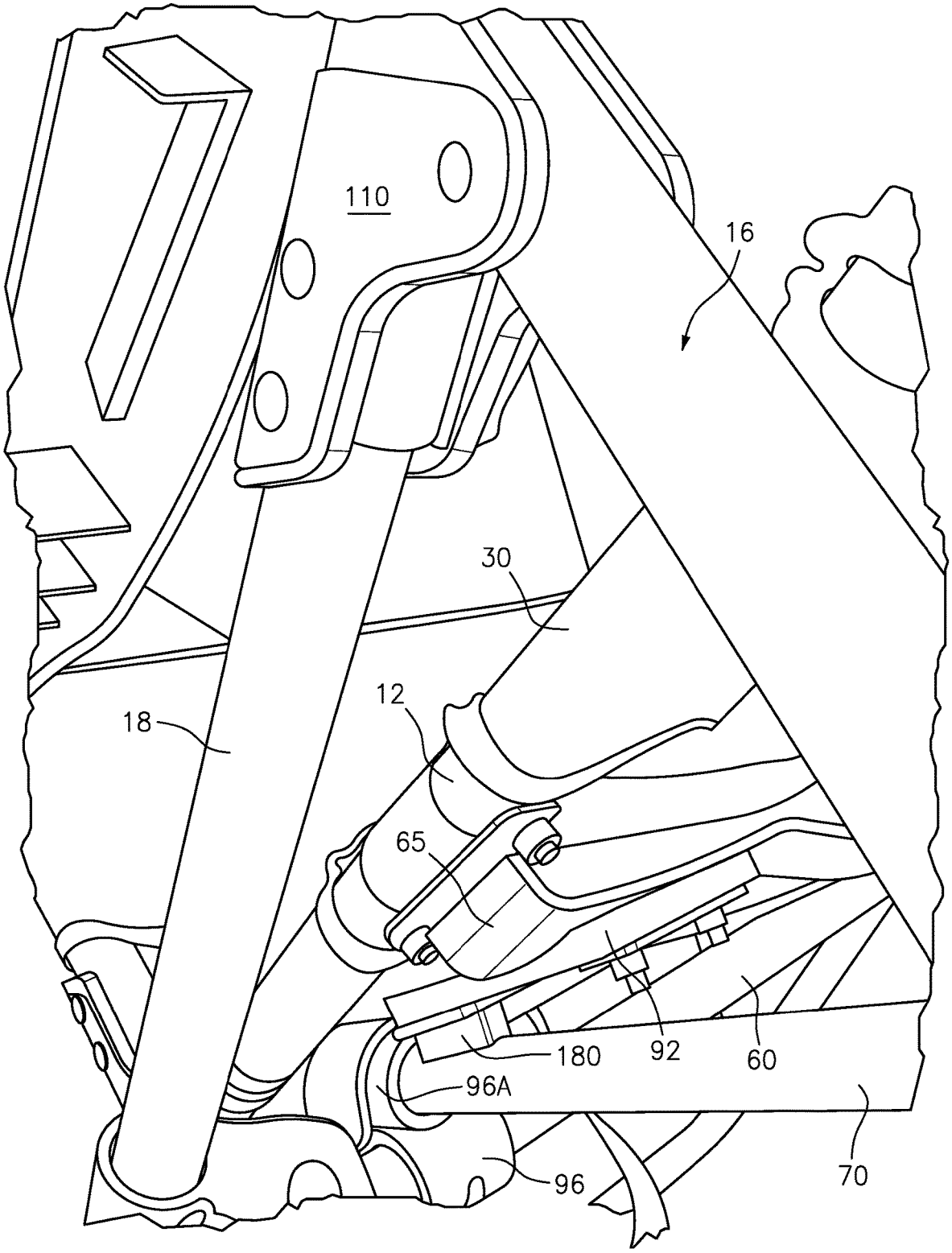

Generally speaking, chair 10, which may be a beach chair or other outdoor chair by way of example and not limitation, comprises an improved assembly that permits and provides for an up (e.g. upright, e.g. FIGS. 1, 2, 8) and down (e.g. reclining, e.g. FIG. 9) rocking motion for chair 10. To achieve this functionality, chair 10 of the preferred embodiments comprises at least one, but preferably two (2) flexible plates 92, 94, preferably made of carbon fiber or fiberglass. As will be discussed in greater detail below, each end of each respective flexible plate 92, 94 is coupled to respective elongated crossbars, as disclosed below. Many if not all of the couplings of components herein are preferably achieved with rivets, pins and/or screw/nut combinations, unless specifically disclosed otherwise herein.

As will be understood, chair 10 rocks backward/forward when force is applied to the back of the chair (e.g. when someone is sitting in chair 10 and/or pressure is applied e.g. to the back of the chair (i.e. as in FIG. 9), causing the flexible plates to flex upward. As should therefore also be understood, the seat and back portion of the chair will return to the original position (e.g. FIGS. 1, 8) when the force upon plates is removed or reduced, thereby allowing the flexing of plates back to their unstressed positions. Of course, a sufficient force in the up/down direction can permit the chair 10 to rock further than the original position, depending on the force being applied.

Figure 1:
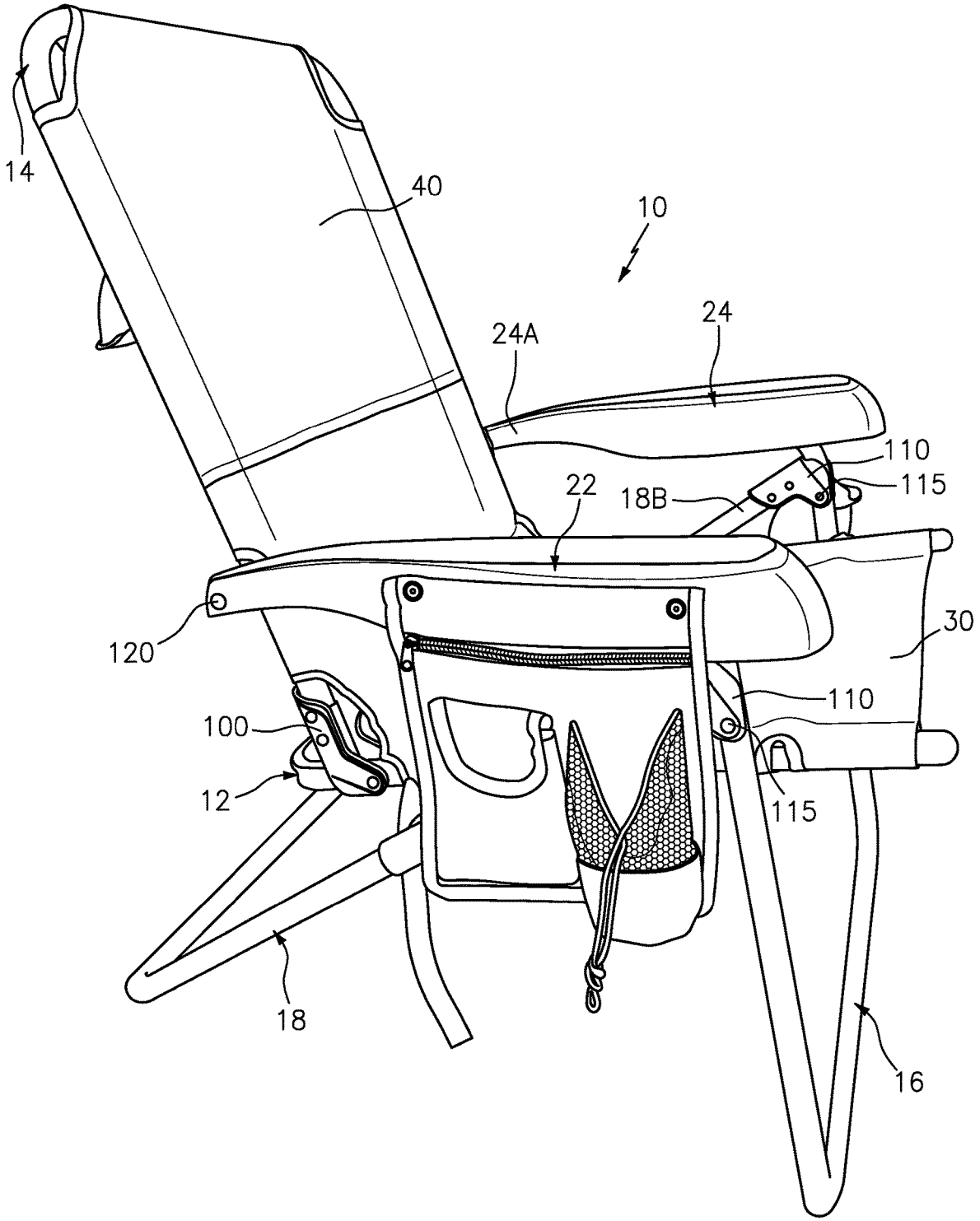
FIG. 1 is a perspective view of a chair constructed in accordance with preferred embodiments of the present invention, showing the chair in an open position.
Figure 2:
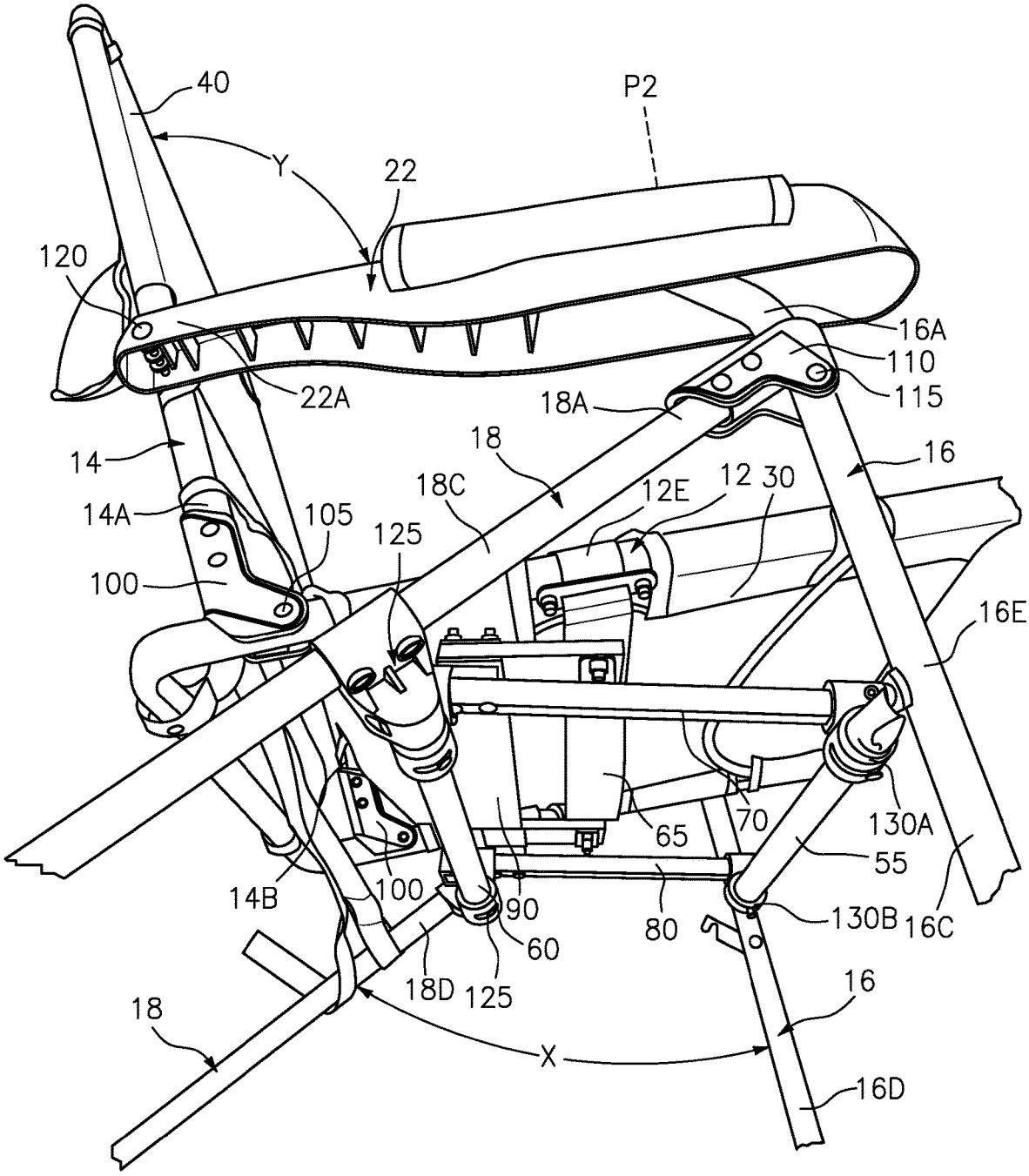
FIG. 2 is a perspective view of the underside of a preferred embodiment of the chair constructed in accordance with preferred embodiments of the present invention.
Figure 7:
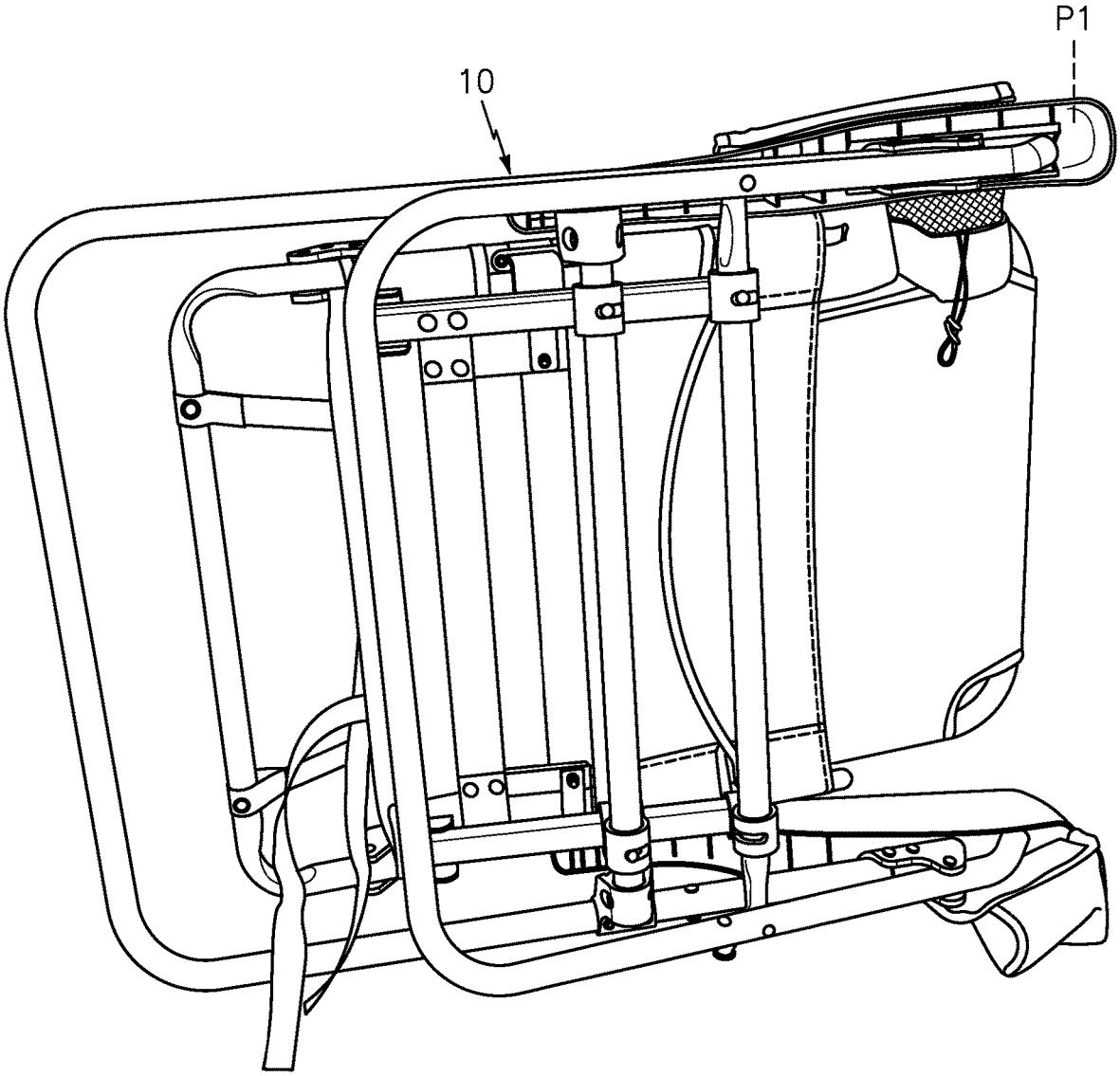
FIG. 7 is a perspective view of the chair of FIG. 1 in a collapsed position.

Turning now to the specifics of the invention, in a preferred embodiment, collapsible rocker chair 10 comprises a frame comprised of metal, metal alloy, plastic and/or combinations of the foregoing. More particularly, the frame comprises a U-shaped seat frame 12 coupled to a U-shaped back frame 14. In a preferred embodiment, a coupler 100 is provided to couple respective ends 14A, 14B of U-shaped back frame 14 to respective segments of U-shaped back seat frame 12 as shown in FIGS. 1, 2. In a preferred embodiment, coupler 100 is connected to U-shaped seat frame 12 using pins 105 to permit rotation of seat frame 12 relative to back frame 14 between an open position (FIGS. 1, 2) and a collapsed position (FIG. 7).

Chair 10 further includes a seat panel 30 coupled to the U-shaped seat frame 12 and a back support panel 40 coupled to the U-shaped back frame 14. In a preferred embodiment, the seat panel 30 and the back support panel 40 are flexible sheets of fabric and/or other woven material that are wrapped around and/or stitched to the respective U-shaped frames 12, 14 as shown in the figures and as would be well known in the art. Alternative methods of attaching the seat panel 30 to the U-shaped seat frame 12 and the back support panel 40 to the U-shaped back frame 14 could be used, including but not limited to using one or more nylon cords that wrap around the respective U-shaped seat or back frames 12, 14 and along the periphery thereof through a plurality of eyelets (not shown) around the periphery of respective seat panel and back support panels 30, 40.

Chair 10 also includes a U-shaped front leg frame generally indicated at 16 coupled to a U-shaped back leg frame generally indicated at 18. As shown in FIG. 2, in a preferred embodiment, a first end 18A of the U-shaped back leg 18 is rotatably coupled to the first segment of the U-shaped front leg frame 16 with a coupler 110. Similarly, a second end 18B of the U-shaped back leg 18 is rotatably coupled to the second segment of the U-shaped front leg frame 16. Preferably, couplers 110 comprises pins 115 to permit rotation of the U-shaped front leg frame 16 relative to the U-shaped back leg 18 between an open position (FIGS. 1, 2) and a collapsed position (FIG. 7).

Collapsible rocker chair 10 also includes a first arm rest 22 rotatably coupled via a pin 120 at one end 22A thereof to a first segment of the U-shaped back frame 14. In an identical manner, a second arm rest 24 is coupled at one end 24A thereof to a second segment of the U-shaped back frame. In this way, arm rests 22, 24 are rotatable relative to the U-shaped back frame 14 as indicated by arrow "Y" in FIG. 2 between an open position (FIGS. 1, 2) and a collapsed position (FIG. 7).

Figure 3:
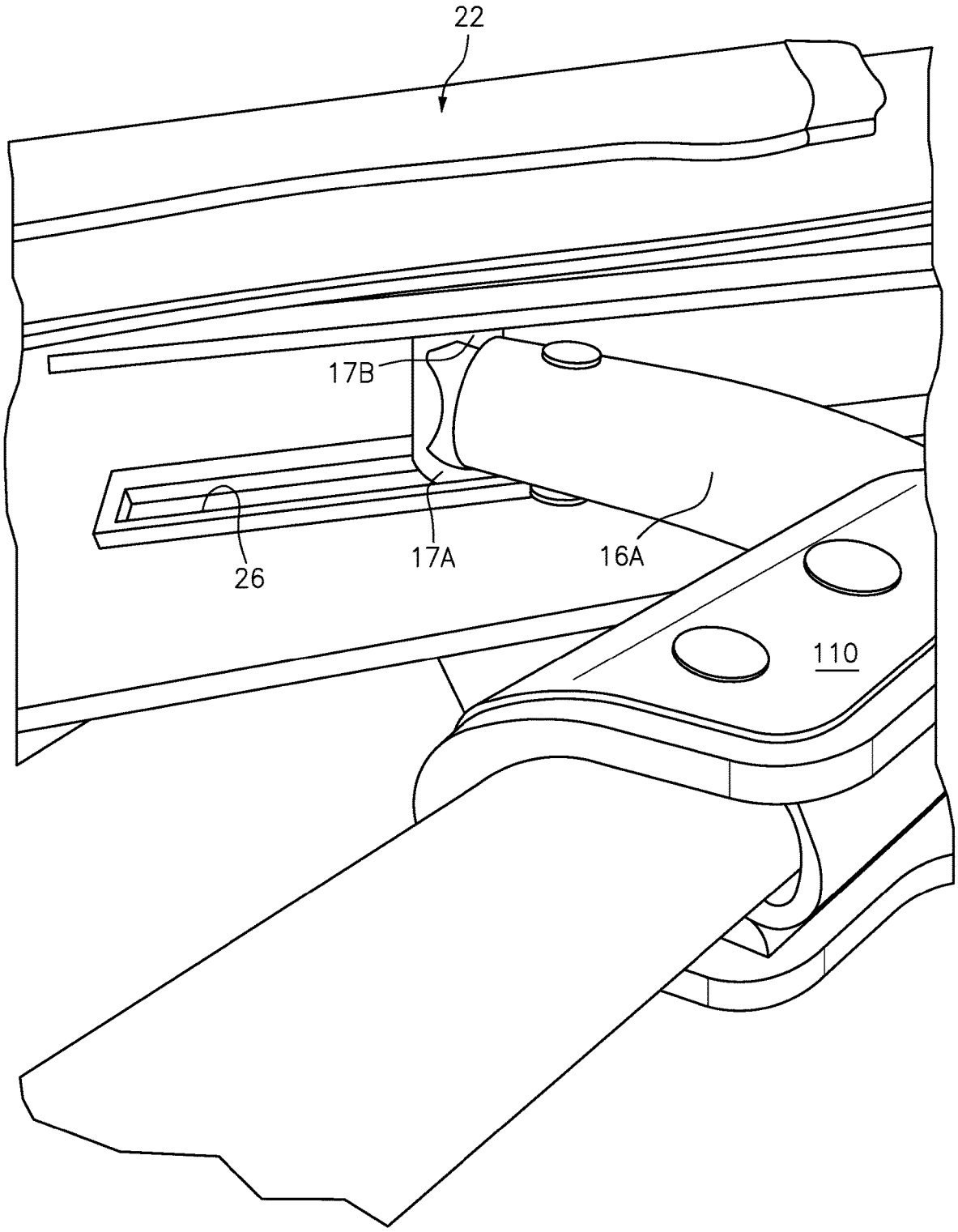
FIG. 3 is a perspective view of the underside of one of the two armrests, the other of which is in mirror/identical image, of a preferred embodiment of the chair constructed in accordance with the present invention.
Figure 4:
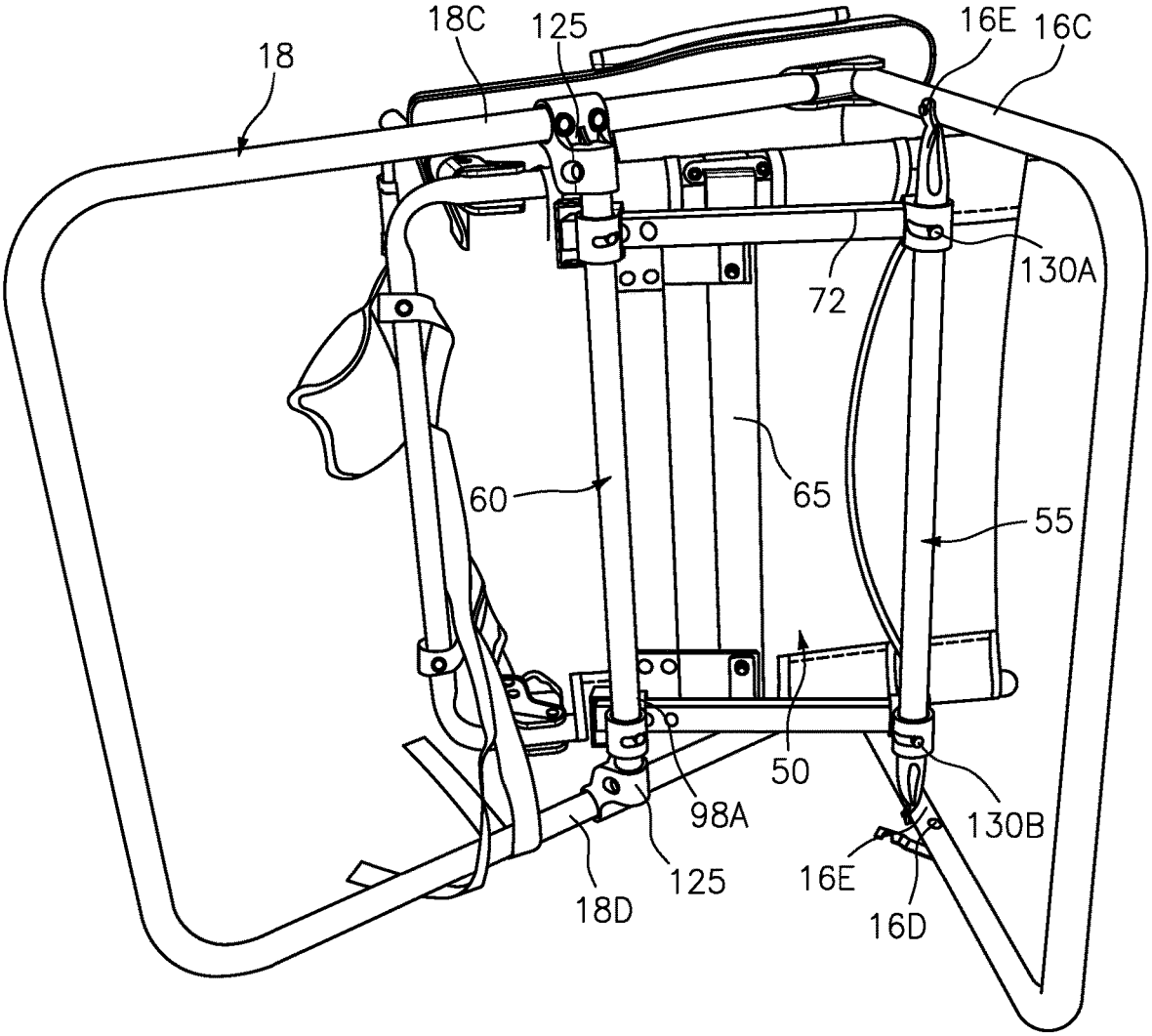
FIG. 4 is yet another perspective view of the chair of FIG. 1 showing additional features in accordance with preferred embodiments of the present invention.

Reference is next made to FIG. 3 which illustrates a preferred underside of arm rest 22 (arm rest 24 being made in mirror and/or identical image). As shown in FIG. 3, the underside of arm rest 22 is provided with an enclosed slot 26, within which is slidably positioned an end 16A of the U-shaped front leg frame 16. Preferably, end 16A of U-shaped front leg frame 16 comprises shoulders 17A, 17B that are constrained within slot 26 but are nevertheless permitted to move along, and specifically preferably slide within and along slot 26. While not specifically shown, it should be understood that the underside of arm rest 24 is made identically to arm rest 22, and within which is slidably positioned the other end 16B of the U-shaped front leg frame 16. Identically, end 16B of U-shaped front leg frame 16 comprises shoulders similar to end 16A that are constrained within the enclosed slot of arm rest 24 but are likewise permitted to move along, and in particular, slide within and along the slot in armrest 24. Alternatively, roller wheels may be provided at the ends 16A, 16B of U-shaped front leg frame 16 to allow the leg frame 16 to move with the seat and back assembly when chair 10 is rocking and/or chair 10 is being folded, as disclosed below. Similarly, such wheels would move along and otherwise be constrained within the slots provided on the underside of each arm rest 22, 24. Along with permitting a rocking motion as disclosed below, the foregoing construction and use of the respective slots in the underside of each arm rest 22, 24 (in combination with the structure/construction of the U-shaped front leg frame 16) permit the sliding of ends 16A, 16B within the respective slots to permit the chair 10 to be opened from a collapsed position (FIGS. 1, 2) and to be collapsed from an open position (FIG. 7).

Reference is now particularly made to FIGS. 4-7 for a disclosure of a preferred seat support assembly, generally indicated at 50. In a preferred embodiment, seat support assembly 50 comprises a front leg crossbar 55 coupled between a first segment 16C of the U-shaped front leg frame 16 and a second segment 16D of the U-shaped front leg frame 16. The coupling of front leg crossbar 55 to the respective segments 16C, 16D of leg frame 16 is preferably with rivets, pins and/or a nut and bolt combination, generally indicated at respective positions 16E on leg frame 16.

Seat support assembly 50 also comprises a rear leg crossbar 60 coupled between a first segment 18C of the U-shaped back leg frame 18 and a second segment 18D of the U-shaped back leg frame 18. Preferably, the coupling of U-shaped back rear leg crossbar 60 to the respective segments 18C, 18D of U-shaped back leg frame 18 is with the use of respective couplers 125 on each side as shown in the Figures.

Seat support assembly 50 also comprises a first crossmember 65 coupled between a first segment 12C of the U-shaped seat frame 12 and a second segment 12D of the U-shaped seat frame 12. Preferably, the coupling of first cross member 65 to the respective segments 12C, 12D of U-shaped seat frame 12 includes welding and/or the use of rivets, pins and/or a nut and bolt combination, generally indicated at positions 12E on U-shaped seat frame 12. To be sure, an identical construction is provided on segment 12D, with crossmember 65 being welded to second segment 12D. In a preferred embodiment, cross member 65 is a flat elongated member preferably made of fiberglass composite.

Seat support assembly 50 further comprises a first slider 70 having a first end 72 and a second end 74, wherein the first end 72 of the first slider 70 is coupled to the front leg crossbar 55 with a coupler 130A, and wherein the first slider 70 is also supported by the rear leg crossbar 60. Seat support assembly 50 further includes a second slider 80 having a first end 82 and a second end 84, wherein the first end 82 of the second slider 80 is coupled to the front leg crossbar 55 with a coupler 130B, and wherein the first slider is also supported by the rear leg crossbar 60. Seat support assembly further includes a second crossmember 90 coupled between the first slider 70 and the second slider 80, preferably by screws, etc. Seat support assembly 50 further includes a first plate 92 coupled between a first end 65A of the first crossmember 65 and a first end 90A of the second crossmember 90, and a second plate 94 coupled between a second end 65B of the first crossmember 65 and a second end 90B of the second crossmember 95. Again, screws/nut couplings are preferred but other means of attachment are certainly contemplated herein as discussed above. A spacer 180 (see FIGS. 8, 9) may be provided on each side of the chair to ensure proper spacing and alignment of the components disclosed herein.

With the above construction, it can be seen that chair 10 is provided with an improved rocking assembly that permits and provides an up (e.g. upright, e.g. FIGS. 1, 2, 8) and down (e.g. back/reclining, e.g. FIG. 9) rocking motion for chair 10. This functionality is achieved in part by the at least one but preferably two (2) flexible plates 92, 94, that will flex as the chair 10 rocks back and forth (e.g. down/up, up/down). As should therefore also be understood, when the force is removed and/or reduced, the seat and back portion of the chair will return to its original position, thereby allowing the flexing of plates back to their unstressed positions.

While the present invention has been described with respect to preferred embodiments, those skilled in the art will readily appreciate that various changes and/or modifications can be made to the invention without departing from the spirit or scope of the invention. For example, instead of the aforementioned plates 92, 94, other flexible materials can be used in place thereof (or in addition thereto). For example, springs that can flex can be used instead of, or in additional to, plates 92, 94. Such plates or springs can thus achieve the means for flexing as disclosed herein.

Figure 5:
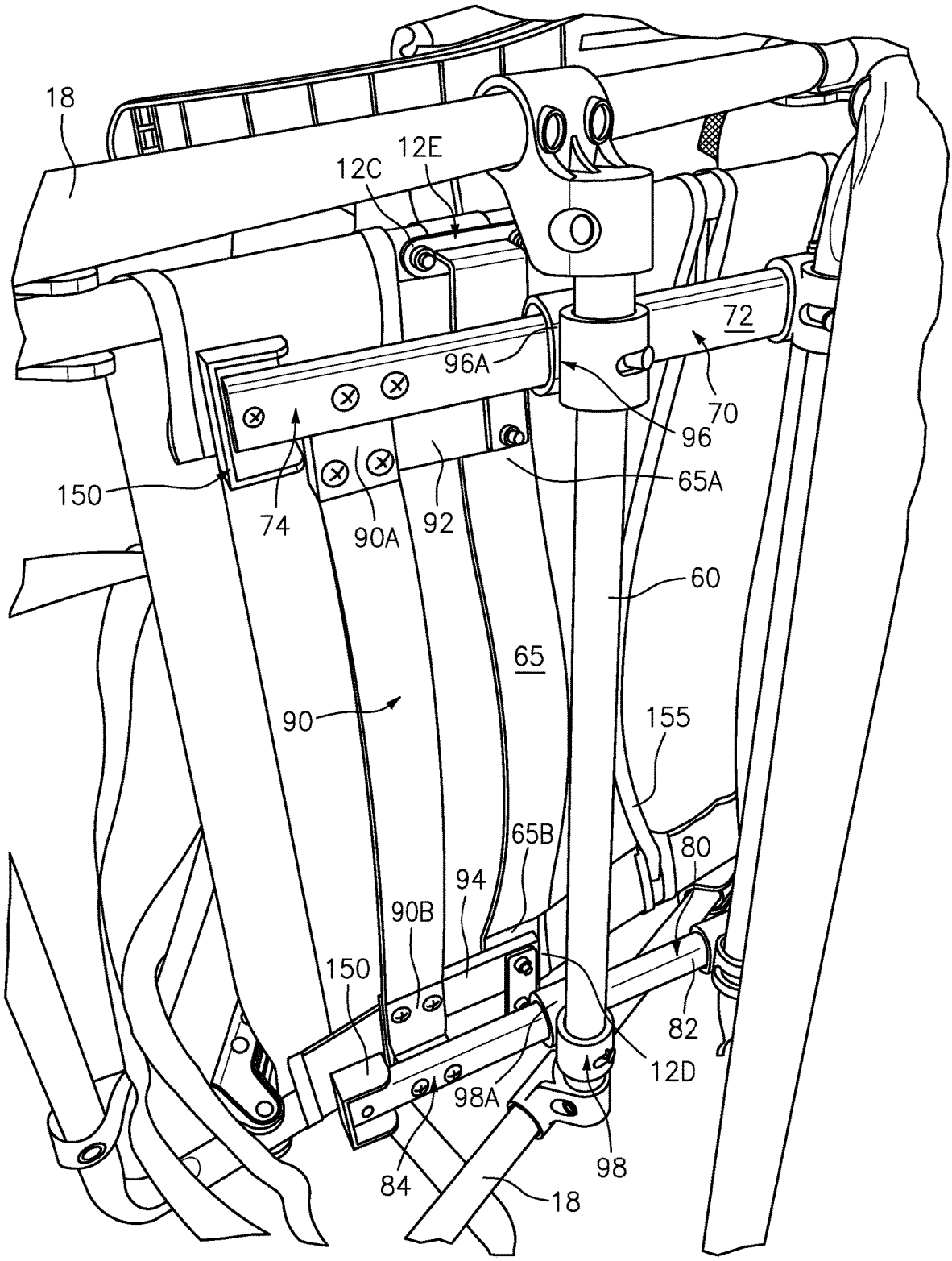
FIG. 5 is a closer view of a seat support assembly of the chair in a collapsed position.
Figure 6:
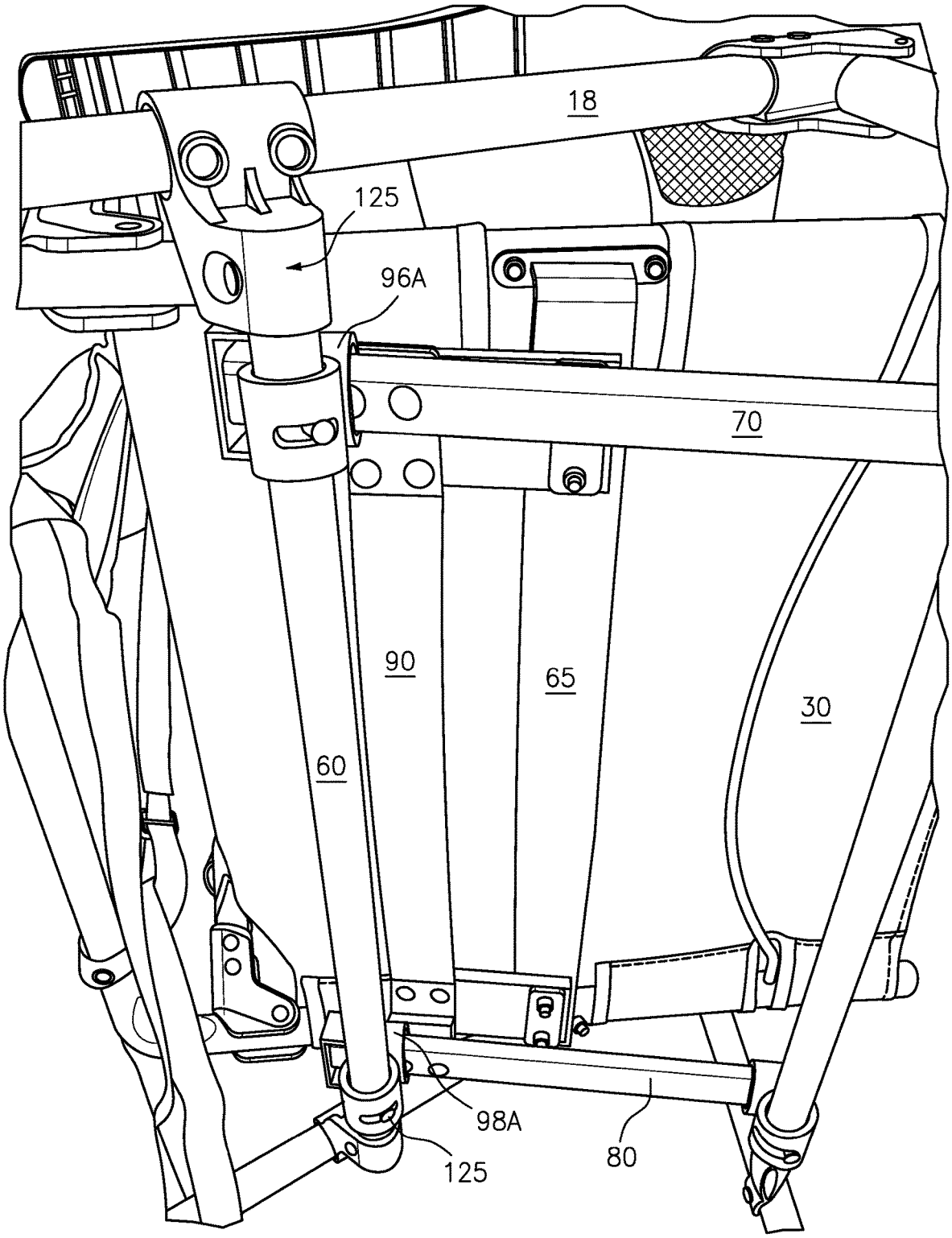
FIG. 6 is yet another perspective view of additional features of the present invention of the chair in the open position.

Reference is now made to a preferred construction that facilitates the collapsing of the chair from its open position (FIGS. 1 and 2) to its collapsed position (e.g. FIG. 7). In a preferred embodiment, a first coupler, generally indicated at 96, comprises a preferably circular clamp coupled to crossbar 60 and a c-shaped holder 96A integrally formed (or otherwise attached) to the circular clamp portion (e.g. as coupler 96 is preferably made of plastic or can even be of metal material), is coupled to the rear leg crossbar 60 and a second coupler 98 (preferably made identically to coupler 96) is also coupled to the rear leg crossbar 60. In this way, the second end 74 of the first slider 70 is slidable through the c-shaped holder 96A and the second end 84 of the second slider 80 is slidable through the c-shaped holder 98A. It should be understood that "the second end" of each slider is not limited to only the final "tip" of each slider. For example and as illustrated in the Figures, e.g. FIG. 5, at least ¼ to ⅓ of the respective ends 74, 84 of the respective sliders can slide through and along the respective couplers 96, 98. In this way, during a collapsing of the chair from an opened position (e.g. FIG. 1) to a collapsed position (e.g. FIG. 7), the U-shaped back leg 18 and the U-shaped front leg 16 are rotatable relative to and towards each other (as shown by arrow X in FIG. 2), and the first slider 70 slides through the first coupler 96 from a first position (e.g. as illustrated in FIG. 2) to a second position (e.g. as illustrated in FIG. 5), and the second slider 80 slides through the second coupler 98 from a first position (e.g. as illustrated in FIG. 2) to a second position (e.g. as illustrated in FIG. 5).

As discussed above with respect to FIGS. 2 and 3, the first arm 22 comprises the slot 26 on the underside thereof and, in an identical construction, the second arm rest 24 comprises an identical slot on the underside thereof. In this way, during a movement of the chair between a forward (e.g. FIG. 1, 2) and a rearward position (e.g. FIG. 9), the first end 16A of the first segment of the U-shaped front leg frame slides along the slot in the first arm rest from a first position to a second position, and a first end 16B of the second segment of the U-shaped front leg frame slides along the slot in the second arm rest from a first position to a second position. Likewise, from a rearward position (e.g. FIG. 9) to a forward position (e.g. FIG. 1, 2), the first end 16A of the first segment of the U-shaped front leg frame slides along the slot in the first arm rest from the second to the first position and a first end 16B of the second segment of the U-shaped front leg frame slides similarly along the slot in the second arm rest from the second position to the first position.

As can also be seen in comparing FIG. 2 and FIG. 7, during an opening of the chair from its collapsed position (FIG. 7) to a least a more open position (FIG. 2), the first end 16A of the first segment of the U-shaped front leg frame 16 slides along the slot 26 in the first arm rest 22 from a first position P1 (see FIG. 7) to a second position P2 (see FIG. 2), and a first end of the second segment 16B of the U-shaped front leg frame 16 slides along the slot 26 in the second arm rest 24 from a similar corresponding first position P1 to a second corresponding position P2. Similarly, during the collapsing of the chair from its open position to its collapsed position (FIG. 7), the first end 16A of the first segment of the U-shaped front leg frame 16 slides along the slot 26 in the first arm rest 22 from the second position P2 (see FIG. 2) to the first position P1 (see FIG. 7), and a first end of the second segment 16B of the U-shaped front leg frame 16 slides along the slot 26 in the second arm rest 24 from a similar corresponding second position P2 to the first corresponding position P1. It should also be understood that during a rocking of the chair back and forth the ends 16A, 16B of the leg frame 16 will slide along and within the respective slots 26, Stoppers 150 may be provided at the respective ends of the sliders 70, 80 to prevent sliders 70, 80 from inadvertently being decoupled from couplers 96, 98. A further seat support bar 155 may be rotatably coupled the respective first and second segments of U-shaped front leg from 12 to provide support to a user's seat/leg area as would be known in the art.

It should thus be clear that in the collapsed position, the U-shaped back frame 14 and the U-shaped seat frame 12 rotate towards each other around pin 105, and the U-shaped front leg frame 16 and the U-shaped back leg frame 18 are foldable towards each other about pin 115, all as illustrated in FIGS. 2 and 7, by way of example.

The foregoing should be understood to be a construction of a preferred chair for use in connection with the present invention. However, it should be clearly understood that other folding chairs are also contemplated for use in connection with the present invention as to the rocker configuration, such as for example and not limitation, front-to-back, side-to-side, or quad-fold style folding beach, sporting, and event chairs, whether made of metal, metal alloy, plastic, wood and/or combinations thereof, with suitable modifications as would understood in the art.

Backpack straps may be provided between the rear segment of back leg frame 18 and the back support panel (e.g. stitched thereto) to facilitate the carrying of chair 10. A pillow may also be provided and preferably removably couplable by way of straps and Velcro as would be known in the art.

As can now be seen by the disclosed embodiments, the present provides significant improvements and advantages over backpack/chair combinations known the in art.

As should now be appreciated, the benefits of the present invention over the prior art examples are numerous, including but not limited to a rocker chair that provides for improved rocking motion capability, providing improved support for the user that is sitting and/or rocking in the chair, and providing an improved folding mechanism all of which are easier, more efficient, more reliable and more efficiently manufactured than other folding and rocker chairs known the in art.

As thus should now be understood by those skilled in the art, the present invention overcomes all of the aforementioned deficiencies while also providing the advantages mentioned herein as well as those advantages that should be understood by those skilled in the art.

Other advantages and objectives are deemed to be apparent from the disclosure herein. It should also be appreciated that the present invention can be implemented and utilized in numerous ways. While the present invention has been described with respect to preferred embodiments, those skilled in the art will readily appreciate that various changes and/or modifications can be made to the invention without departing from the spirit or scope of the invention.

For example, the couplers disclosed herein are made of plastic, but other materials, such as metal can be used. Also, the coupling of such couplers to the respective components herein, as well as the joining and connecting of crossbars and plates, etc. to the other components are preferably achieved with rivets, screws and pins, but those skilled in the art would understand, and the present invention contemplates, that such connections could be done with components other than as disclosed herein or such components disclosed herein could be changed to other ways as disclosed herein (e.g. a rivet could be substituted for a screw/nut, or vice versa, etc.). Also as disclosed herein, the preferred frame comprises a U-shaped seat frame, a U-shaped back frame, a U-shaped front leg frame and a U-shaped back leg frame as such U-shaped frame members are understood and well-known in the art. However, such an embodiment is only the preferred embodiment and other frame shapes are contemplated herein, and as also contemplated in the claims herein.

What is claimed is:

1. A chair comprising:

a U-shaped seat frame coupled to a U-shaped back frame, a seat panel coupled to the U-shaped seat frame and a back support panel coupled to the U-shaped back frame;

a U-shaped front leg frame coupled to a U-shaped back leg frame, a first arm rest coupled at one end thereof to a first segment of the U-shaped back frame;

a second arm rest coupled at one end thereof to a second segment of the U-shaped back frame;

a front leg crossbar coupled between a first segment of the U-shaped front leg frame and a second segment of the U-shaped front leg frame;

a rear leg crossbar coupled between a first segment of the U-shaped back leg frame and a second segment of the U-shaped back leg frame;

a first slider having a first end, wherein the first end of the first slider is coupled to the front leg crossbar, and wherein the first slider is supported by the rear leg crossbar;

a second slider having a first end, wherein the first end of the second slider is coupled to the front leg crossbar, and wherein the first slider is supported by the rear leg crossbar;

wherein during a collapsing of the chair from an open position to a collapsed position, the (i) U-shaped seat frame rotates relative to the U-shaped back frame, (ii) the U-shaped front leg frame rotates relative to the U-shaped back leg frame, (iii) the first arm rest and the second arm rest rotate relative to the U-shaped back frame, and (iv) the first and second sliders slide relative to the rear leg crossbar.

2. The chair as claimed in claim 1, comprising a first coupler coupled to the rear leg crossbar and a second coupler coupled to the rear leg crossbar, wherein:

the first slider is slidable through the first coupler and the second slider is slidable through the second coupler; and wherein during the collapsing of the chair from the opened position to the collapsed position the first slider slides through the first coupler from a first position to a second position, and the second slider slides through the second coupler from a first position to a second position.

3. The chair as claimed in claim 2, comprising:

a first crossmember coupled between a first segment of the U-shaped seat frame and a second segment of the U-shaped seat frame;

a second crossmember coupled between the first slider and the second slider;

a first means for flexing coupled between a first end of the first crossmember and a first end of the second crossmember, and a second means for flexing coupled between a second end of the first crossmember and a second end of the second crossmember;

wherein the first and second means for flexing will flex during a rocking of the chair between at least one of a rearward and forward position to the other of the forward and rearward position.

4. The chair as claimed in claim 3, wherein the first means for flexing is a first plate coupled between the first end of the first crossmember and the first end of the second crossmember, and the second means for flexing is a second plate coupled between the second end of the first crossmember and the second end of the second crossmember;

wherein the first and second plates will flex during a rocking of the chair between at least one of a rearward and forward position to the other of the forward and rearward position.

5. The chair as claimed claim 1, wherein the first arm rest comprises a slot on the underside thereof and the second arm rest comprises a slot on the underside thereof, and wherein during the rocking of the chair between at least one of a rearward and forward position to the other of the forward and rearward position:

a first end of the first segment of the U-shaped front leg frame moves along the slot in the first arm rest from a first position to a second position, and a first end of the second segment of the U-shaped front leg frame moves along the slot in the second arm rest from a first position to a second position.

6. The chair as claimed claim 1, wherein the first arm rest comprises a slot on the underside thereof and the second arm rest comprises a slot on the underside thereof; wherein during an opening of the chair from its collapsed position to its open position or a collapsing of the chair from its open position to its collapsed position:

a first end of the first segment of the U-shaped front leg frame moves along the slot in the first arm rest from a first position to a second position, and a first end of the second segment of the U-shaped front leg frame moves along the slot in the second arm rest from a first position to a second position.

7. A chair comprising:

a U-shaped seat frame coupled to a U-shaped back frame, a seat panel coupled to the U-shaped seat frame and a back support panel coupled to the U-shaped back frame;

a U-shaped front leg frame coupled to a U-shaped back leg frame, a first arm rest coupled at one end thereof to a first segment of the U-shaped back frame;

a second arm rest coupled at one end thereof to a second segment of the U-shaped back frame;

a front leg crossbar coupled between a first segment of the U-shaped front leg frame and a second segment of the U-shaped front leg frame;

a rear leg crossbar coupled between a first segment of the U-shaped back leg frame and a second segment of the U-shaped back leg frame;

a first crossmember coupled between a first segment of the U-shaped seat frame and a second segment of the U-shaped seat frame;

a second crossmember support assembly;

a second crossmember supported by the second crossmember support assembly;

a first means for flexing coupled between a first end of the first crossmember and a first end of the second crossmember, and a second means for flexing coupled between a second end of the first crossmember and a second end of the second crossmember; and wherein the first and second means for flexing will flex during a rocking of the chair between at least one of a rearward and forward position to the other of the forward and rearward position.

8. The chair as claimed in claim 7, wherein the first means for flexing is a first plate coupled between the first end of the first crossmember and the first end of the second crossmember, and the second means for flexing is a second plate coupled between the second end of the first crossmember and the second end of the second crossmember;

wherein the first and second plates will flex during a rocking of the chair between at least one of a rearward and forward position to the other of the forward and rearward position.

9. The chair as claimed in claim 7, wherein the second crossmember support assembly comprises (i) a first slider having a first end, wherein the first end of the first slider is coupled to the front leg crossbar, and wherein the first slider is supported by the rear leg crossbar; and (ii) a second slider having a first end, wherein the first end of the second slider is coupled to the front leg crossbar, and wherein the first slider is supported by the rear leg crossbar.

10. The chair as claimed in claim 7, wherein the second crossmember support assembly comprises a first coupler coupled to the rear leg crossbar and a second coupler coupled to the rear leg crossbar, wherein the second end of the first slider is slidable through the first coupler and the second end of the second slider is slidable through the second coupler; and wherein:

during a collapsing of the chair from an opened position to a collapsed position (i) the U-shaped seat frame rotates relative to the U-shaped back frame, (ii) the U-shaped front leg frame rotates relative to the U-shaped back leg frame, (iii) the first arm rest and the second arm rest rotate relative to the U-shaped back frame, and (iv) the first slider slides through the first coupler from a first position to a second position, and the second slider slides through the second coupler from a first position to a second position.

11. The chair as claimed claim 7, wherein the first arm rest comprises a slot on the underside thereof and the second arm rest comprises a slot on the underside thereof; and wherein during an opening of the chair from its collapsed position to its open position or a collapsing of the chair from its open position to its collapsed position:

a first end of the first segment of the U-shaped front leg frame moves along the slot in the first arm rest from a first position to a second position, and a first end of the second segment of the U-shaped front leg frame moves along the slot in the second arm rest from a first position to a second position.

12. The chair as claimed claim 7, wherein the first arm comprises a slot on the underside thereof and the second arm rest comprises a slot on the underside thereof; and wherein during the rocking of the chair between at least one of a rearward and forward position to the other of the forward and rearward position:

a first end of the first segment of the U-shaped front leg frame moves along the slot in the first arm rest from a first position to a second position, and a first end of the second segment of the U-shaped front leg frame moves along the slot in the second arm rest from a first position to a second position.

13. A chair comprising:

a seat frame coupled to a back frame; a seat panel coupled to the seat frame and a back support panel coupled to the back frame; a front leg frame coupled to a back leg frame; a first arm rest coupled at one end thereof to a first segment of the back frame; a second arm rest coupled at one end thereof to a second segment of the back frame; a front leg crossbar coupled between a first segment of the front leg frame and a second segment of the front leg frame; a rear leg crossbar coupled between a first segment of the back leg frame and a second segment of the back leg frame; and a collapsing assembly for permitting a collapsing the chair from an open position to a collapsed position, wherein the collapsing assembly comprises:

a first slider having a first end, wherein the first end of the first slider is coupled to the front leg crossbar, and wherein the first slider is supported by the rear leg crossbar;

a second slider having a first end, wherein the first end of the second slider is coupled to the front leg crossbar, and wherein the first slider is supported by the rear leg crossbar;

wherein during a collapsing of the chair from an open position to a collapsed position, the (i) seat frame rotates relative to the back frame, (ii) the front leg frame rotates relative to the back leg frame, (iii) the first arm rest and the second arm rest rotate relative to the back frame, and (iv) the first and second sliders slide relative to the rear leg crossbar.

14. The chair as claimed in claim 13, comprising a first coupler coupled to the rear leg crossbar and a second coupler coupled to the rear leg crossbar, wherein the first slider is slidable through the first coupler and the second slider is slidable through the second coupler; and wherein during the collapsing of the chair from the opened position to the collapsed position the first slider slides through the first coupler from a first position to a second position, and the second slider slides through the second coupler from a first position to a second position.

15. The chair as claimed in claim 13, wherein each of the seat frame, back frame, front leg frame and back leg frame are all U-shaped.

16. A chair comprising:

a seat frame coupled to a back frame; a seat panel coupled to the seat frame and a back support panel coupled to the back frame; a front leg frame coupled to a back leg frame; a first arm rest coupled at one end thereof to a first segment of the back frame; a second arm rest coupled at one end thereof to a second segment of the back frame; a front leg crossbar coupled between a first segment of the front leg frame and a second segment of the front leg frame; a rear leg crossbar coupled between a first segment of the back leg frame and a second segment of the back leg frame; and means for flexing, wherein the means for flexing will flex during a rocking of the chair between at least one of a rearward and forward position to the other of the forward and rearward position, wherein the means for flexing comprises a first crossmember coupled between a first segment of the seat frame and a second segment of the seat frame; a second crossmember support assembly; a second crossmember supported by the second crossmember support assembly; a first flexible member coupled between a first end of the first crossmember and a first end of the second crossmember, and a second flexible member coupled between a second end of the first crossmember and a second end of the second crossmember; and wherein the first and second flexible members will flex during a rocking of the chair between at least one of a rearward and forward position to the other of the forward and rearward position.

17. The chair as claimed in claim 16, wherein the first flexible member is a first plate coupled between the first end of the first crossmember and the first end of the second crossmember, and the second flexible member is a second plate coupled between the second end of the first crossmember and the second end of the second crossmember;

wherein the first and second plates will flex during a rocking of the chair between at least one of a rearward and forward position to the other of the forward and rearward position.

18. The chair as claimed in claim 16, wherein each of the seat frame, back frame, front leg frame and back leg frame are all U-shaped.

* * * * *